US010044118B2

(12) United States Patent
Farole et al.

(10) Patent No.: US 10,044,118 B2
(45) Date of Patent: Aug. 7, 2018

(54) ELECTRICAL CONTACT WITH ANTI-ROTATION FEATURE

(71) Applicant: TE CONNECTIVITY CORPORATION, Berwyn, PA (US)

(72) Inventors: Dominic Anthony Farole, Hummelstown, PA (US); Kevin John Duscha, Columbia, PA (US); Gene J. Jacono, Jackson, NJ (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/845,230

(22) Filed: Dec. 18, 2017

(65) Prior Publication Data

US 2018/0109017 A1 Apr. 19, 2018

Related U.S. Application Data

(62) Division of application No. 15/177,496, filed on Jun. 9, 2016.

(51) Int. Cl.

| | |
|---|---|
| ***H01R 9/22*** | (2006.01) |
| ***H01R 9/24*** | (2006.01) |
| ***H01R 13/436*** | (2006.01) |
| ***H01R 4/18*** | (2006.01) |
| ***H01R 13/422*** | (2006.01) |
| *H01R 13/04* | (2006.01) |

(52) U.S. Cl.

CPC ..... *H01R 9/2416* (2013.01); *H01R 4/185* (2013.01); *H01R 13/422* (2013.01); *H01R 13/4367* (2013.01); *H01R 13/04* (2013.01)

(58) Field of Classification Search

CPC .... H01R 9/2416; H01R 4/185; H01R 13/422; H01R 13/4367; H01R 13/04

USPC ..... 439/352, 722, 733.1, 746, 752.5

See application file for complete search history.

(56) References Cited

U.S. PATENT DOCUMENTS

| | | | | |
|---|---|---|---|---|
| 3,178,669 | A | 4/1965 | Roberts | |
| 4,787,864 | A * | 11/1988 | Hunt, III | H01R 13/4367 439/595 |
| 4,946,399 | A | 8/1990 | Kawashima | |
| 4,973,268 | A | 11/1990 | Smith et al. | |
| 5,015,199 | A | 5/1991 | Hirano et al. | |
| 5,033,980 | A | 7/1991 | Watanabe et al. | |
| 5,254,021 | A | 10/1993 | Yamamoto et al. | |

FOREIGN PATENT DOCUMENTS

| | | |
|---|---|---|
| JP | S57192076 U | 12/1982 |

* cited by examiner

*Primary Examiner* — Khiem Nguyen

(57) ABSTRACT

An electrical contact, connector and assembly. The contact includes a contact portion for mating with a mating contact. A stabilizing portion extends from an end of the contact which is opposite the contact portion. The stabilizing portion cooperates with at least one stabilization member of a housing of an electrical connector to minimize the rotation of the contact relative to the electrical connector. The connector includes a housing having stabilization members provided in contact receiving cavities. The assembly includes a terminal position assurance device which engages the stabilizing portions and cooperates with the stabilizing portions to increase the pull out force required to displace the contacts.

16 Claims, 4 Drawing Sheets

ELECTRICAL CONTACT WITH ANTI-ROTATION FEATURE

CROSS REFERENCE TO RELATED APPLICATIONS

This application claims benefit from and is a divisional of U.S. application Ser. No. 15/177,496 filled Jun. 9, 2016 entitled ELECTRICAL CONTACT WITH ANTI-ROTATION FEATURE, which application is hereby incorporated by reference in its entirety.

FIELD OF THE INVENTION

The present invention is directed to an electrical connector assembly having contacts which cooperate with a housing to prevent unwanted rocking or float of the contacts in the housing.

BACKGROUND OF THE INVENTION

Electrical connectors are used to place electrical devices in communication with one another. A connector includes contacts that transmit signals and/or power of an electrical device to another connector. The contacts positioned in the connectors are often times subject to a large amount of movement, particularly if the contacts are not of a press fit design. This movement or float of the contacts relative to the housing can sometimes be beneficial, allowing the contacts to more easily mate with mating contacts. However, excessive float can cause the contacts to stub on the mating contacts, preventing the proper mating of the connectors. In addition, in certain applications, movement of the contacts in the housing is not beneficial, as the alignment of the contacts should be precisely controlled.

It would be beneficial to provide a connector assembly in which the contact cooperates with the housing to minimize the rotation of the contact relative to the housing. It would also be beneficial to provide a connector assembly to provide a terminal position assurance member which minimizes the float of the contact in the housing.

SUMMARY OF THE INVENTION

An object of the invention is to provide a contact with a stabilizing portion used to minimize the rotation of the contact in a housing. In addition, the stabilizing portion can be used to cooperate with a terminal position assurance member to increase the pull out strength needed for the inadvertent removal of the contact from the housing.

An embodiment is directed to an electrical contact. The contact includes a contact portion for mating with a mating contact. A stabilizing portion extends from an end of the contact which is opposite the contact portion. The stabilizing portion cooperates with the at least one stabilization member of a housing of an electrical connector to minimize the rotation of the contact relative to the electrical connector.

An embodiment is directed to an electrical connector. The connector includes a housing having stabilization members provided in contact receiving cavities. Contacts with contact portions for mating with mating contacts are positioned in the contact receiving cavities. Stabilizing portions of the contacts extend from ends of the contacts which are opposite the contact portions. The stabilizing portions cooperate with the stabilization members to minimize the rotation of the contacts relative to the housing.

An embodiment is directed to an electrical connector assembly. The assembly includes a housing, contacts and a terminal position assurance device. The housing has stabilization members provided in contact receiving cavities. The contacts have contact portions for mating with mating contacts. Stabilizing portions extend from ends of the contacts which are opposite the contact portions. The stabilizing portions cooperate with the stabilization members to minimize the rotation of the contacts relative to the housing. The terminal position assurance device engages the stabilizing portions and cooperates with the stabilizing portions to increase the pull out force required to displace the contacts.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
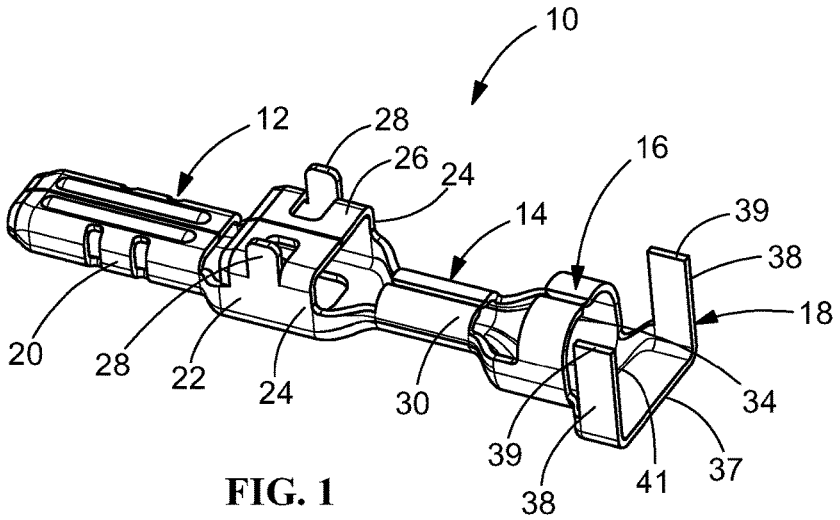
FIG. 1 is a rear perspective view of an illustrative embodiment of a contact according to the invention, the contact having a stabilizing portion extending from a wire receiving end thereof.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

As best shown in FIG. 1, a male contact 10 includes a contact portion 12 for mating with a mating contact (not shown), a wire barrel 14 behind the contact portion 12, an insulation barrel 16 behind the wire barrel 14 and a stabilizing portion 18 extending from the insulation barrel 16 in a direction away from the contact portion 12. The wire barrel 14 is configured for crimped connection with an end of a conductive core of an insulated wire. The insulation barrel 16 is configured for crimped connection with an end of the insulation coating or jacket of the wire. Although a wire barrel 14 and an insulation barrel 16 are shown, the stabilizing portion 18 can be used with other types of termination members without departing from the scope of the invention. The stabilizing portion 18 extends from an end of the contact 10 which is opposite the contact portion 12. Additionally, the stabilizing portion 18 can be used with different contact portions 12, whether such contact portions 12 are male or female. In the illustrative embodiment shown, the terminal 10 is stamped and formed from a metal plate having a good electrical conductivity.

In the illustrative embodiment shown, the contact portion 12 includes a tab portion 20 and a mounting portion 22. While a tab portion 20 is shown, the tab portion 20 may be a socket or other configurations which are capable of mating with a mating contact. The mounting portion 22 is provided between the tab portion 20 and the wire barrel 14. The mounting portion 22 includes sidewalls 24 and a top wall 26. Projections 28 extend from the sidewalls 24 or the top wall 26.

The wire barrel 14 has wire engaging walls 30 which cooperate with a wire to maintain the wire in position in the contact 10. In the embodiment shown, the wire engaging walls 30 are crimped to the wires. However, other termination methods may be used.

The insulation barrel 16 has insulation engaging walls 34 which cooperate with insulation of the wire to maintain the insulation and wire in position in the contact 10. In the embodiment shown, the insulation engaging walls 34 are crimped to the insulation of the wires. However, other termination methods may be used.

The stabilizing portion 18 extends from the insulation barrel 16 in a direction away from the contact portion 12. The stabilizing portion 18 has a first or bottom member 37 which is attached to the insulation barrel 16. Second or side members 38 extend essentially perpendicular from the bottom member 37 to free end surfaces 39. The stabilizing portion 18 is stamped and formed from the same metal plate as the other portions of the contact 10. A transition portion 41 may be provided between the insulation barrel 16 and the stabilizing portion 18.

Figure 2:
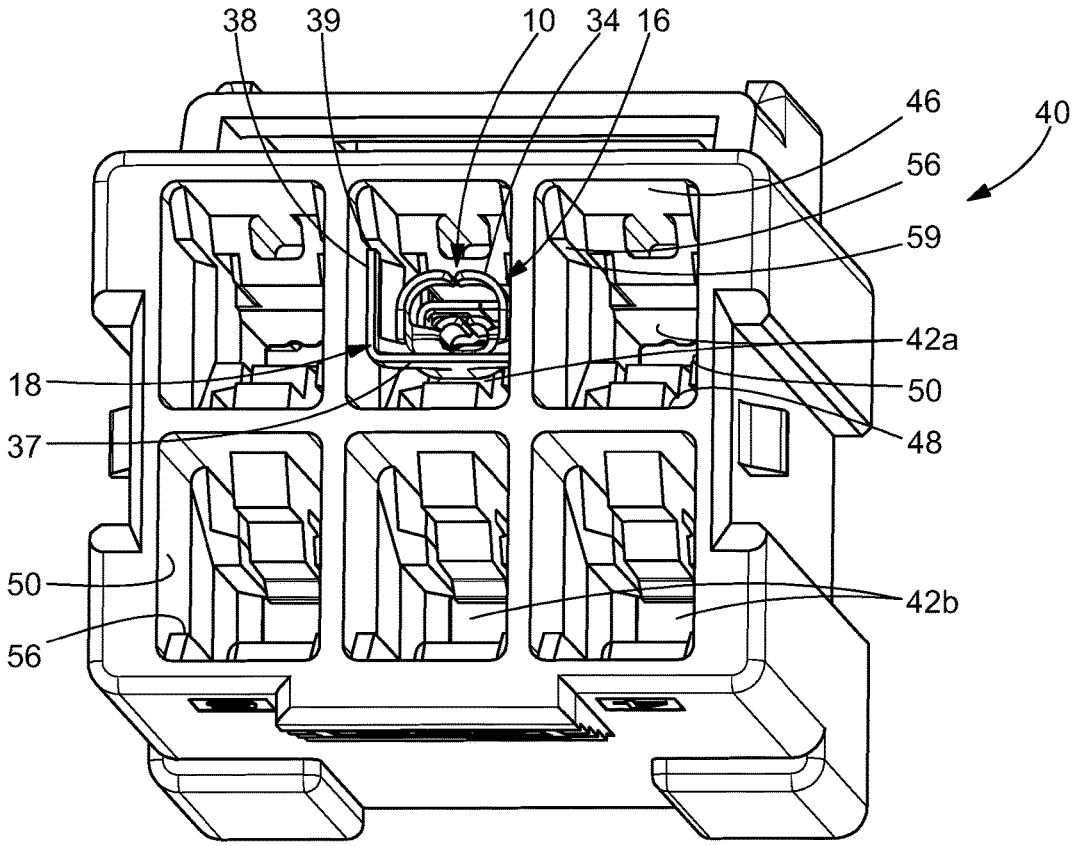
FIG. 2 is a rear perspective view of a housing with stabilization members positioned in contact receiving passages, the housing having one contact inserted into a respective contact receiving passage.
Figure 3:
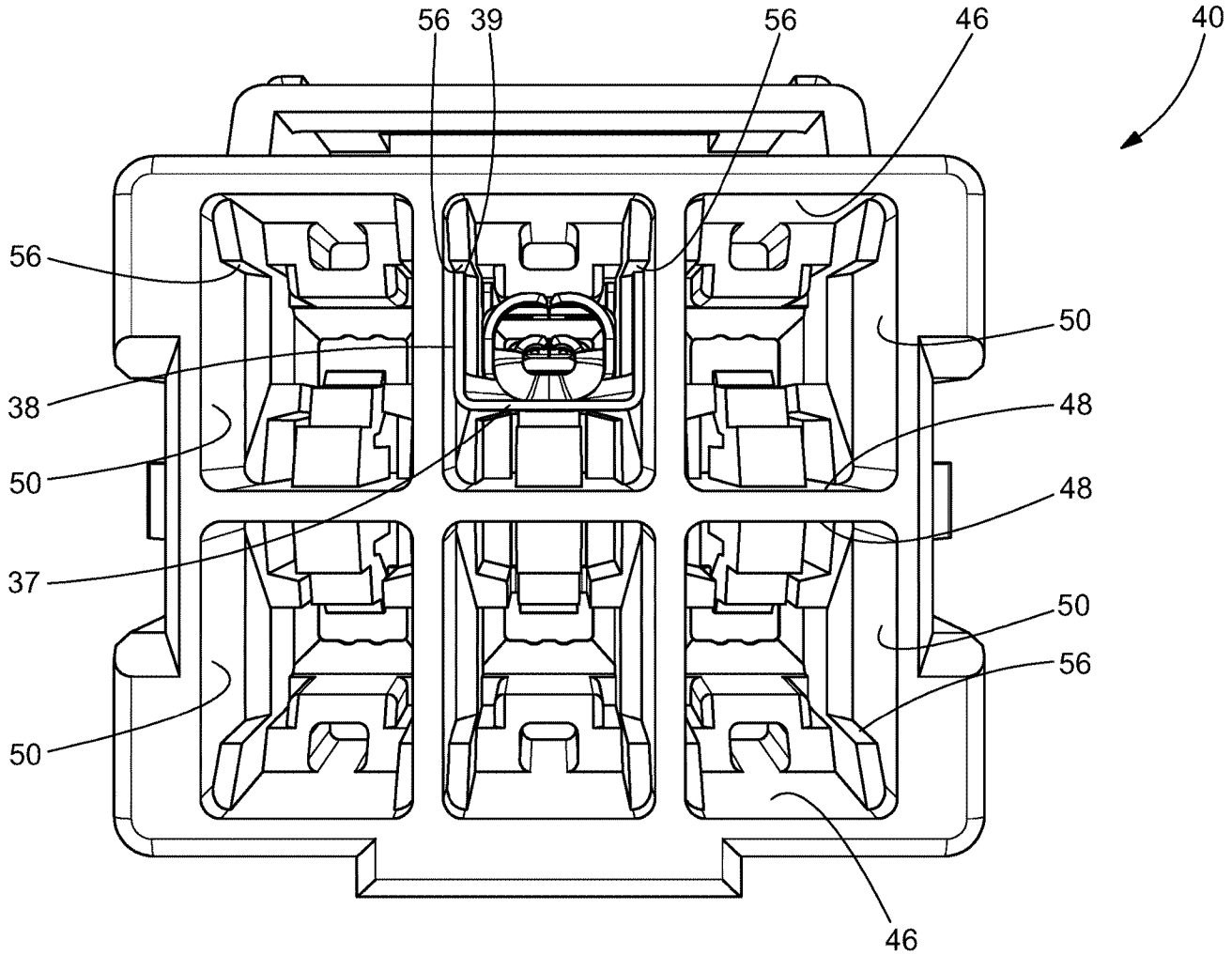
FIG. 3 is a rear plan view of the housing of FIG. 2.

Referring to FIGS. 2 and 3, a connector housing 40 includes multiple contact receiving cavities 42 for receiving contacts 10 therein. While FIGS. 2 through 5 show only one contact 10 inserted into a respective contact receiving cavity 42, in use one or more contact receiving cavities 42 may include contacts 10 therein. In the embodiment shown, the contact receiving cavities 42*a* are mirror images of the contact receiving cavities 42*b*.

Each contact receiving cavity 42 has a top wall 46, a bottom wall 48 and sidewalls 50. Surfaces or stabilizing members 56 are provided in the contact receiving cavity 42. The surfaces or stabilizing members are spaced from the top wall 46 and the sidewalls 50.

The surfaces or stabilizing members 56 are configured to cooperate with the end surfaces 39 of the side members 38 of the stabilizing portion 18 when the contact 10 is inserted into the contact receiving cavity 42. The cooperation of the end surfaces 39 of the side members 38 with the surfaces 56 prevents or minimizes the rotation of the contacts 10 in the contact receiving cavities 42. In addition, in the embodiment shown, the side members 38 are positioned in engagement or proximate to the sidewalls 50 of the contact receiving cavities 42. Consequently, rotation of the contacts 10 in the contact receiving cavities 42 is also prevented or minimized by the engagement of the side members 38 with the sidewalls 50.

A terminal position assurance device 60 includes contact engagement sections 62 which are configured to be positioned in respective contact receiving cavities 42. Each contact engagement section 62 has a first side 64 and a second side 66. In an illustrative embodiment, the terminal position assurance device 60 includes a coupling mechanism 68 (FIG. 4), such as, but not limited to, a latch to allow the terminal position assurance device 60 to be coupled or secured to the housing 40. The terminal position assurance device 60 may be composed of a non-conductive, insulator material, such as, but not limited to, rubber, plastic and/or thermoplastic polymer.

Figure 4:
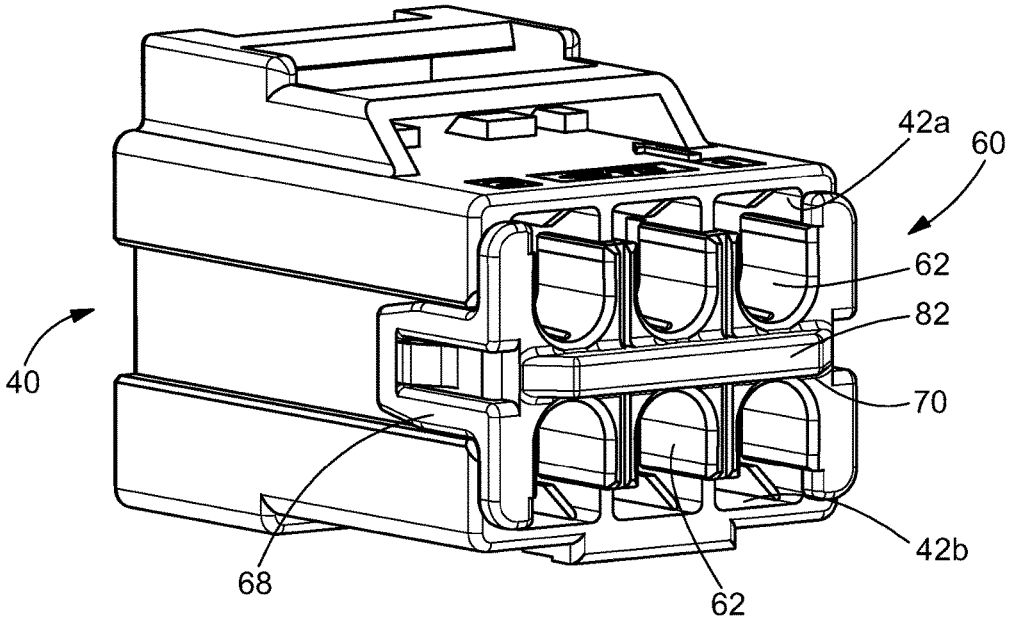
FIG. 4 is a rear perspective view of the housing of FIG. 2 with a terminal position assurance member positioned thereon.
Figure 5:
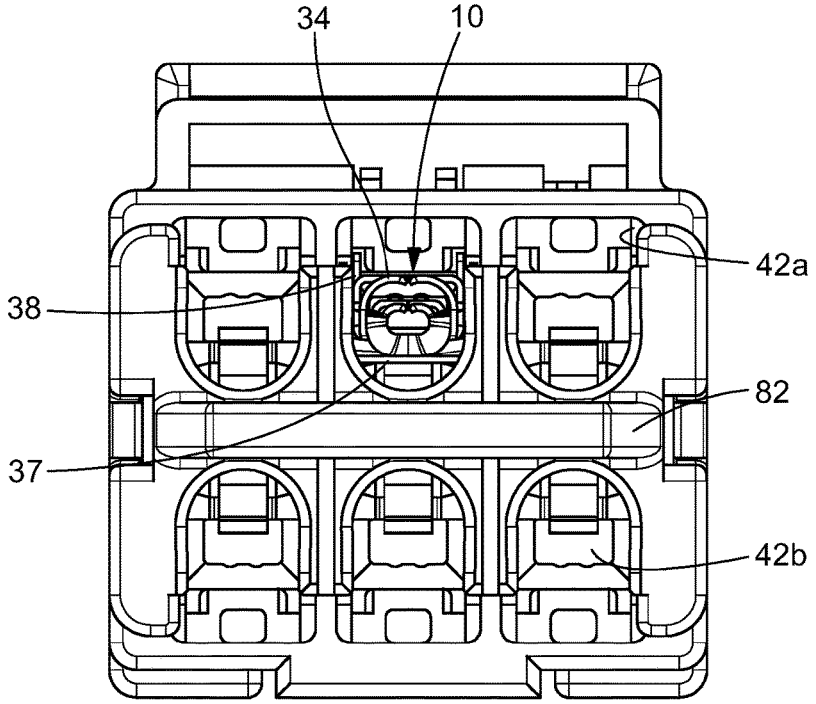
FIG. 5 is a rear plane view of the housing of FIG. 4 with the terminal position assurance member positioned thereon.
Figure 6:
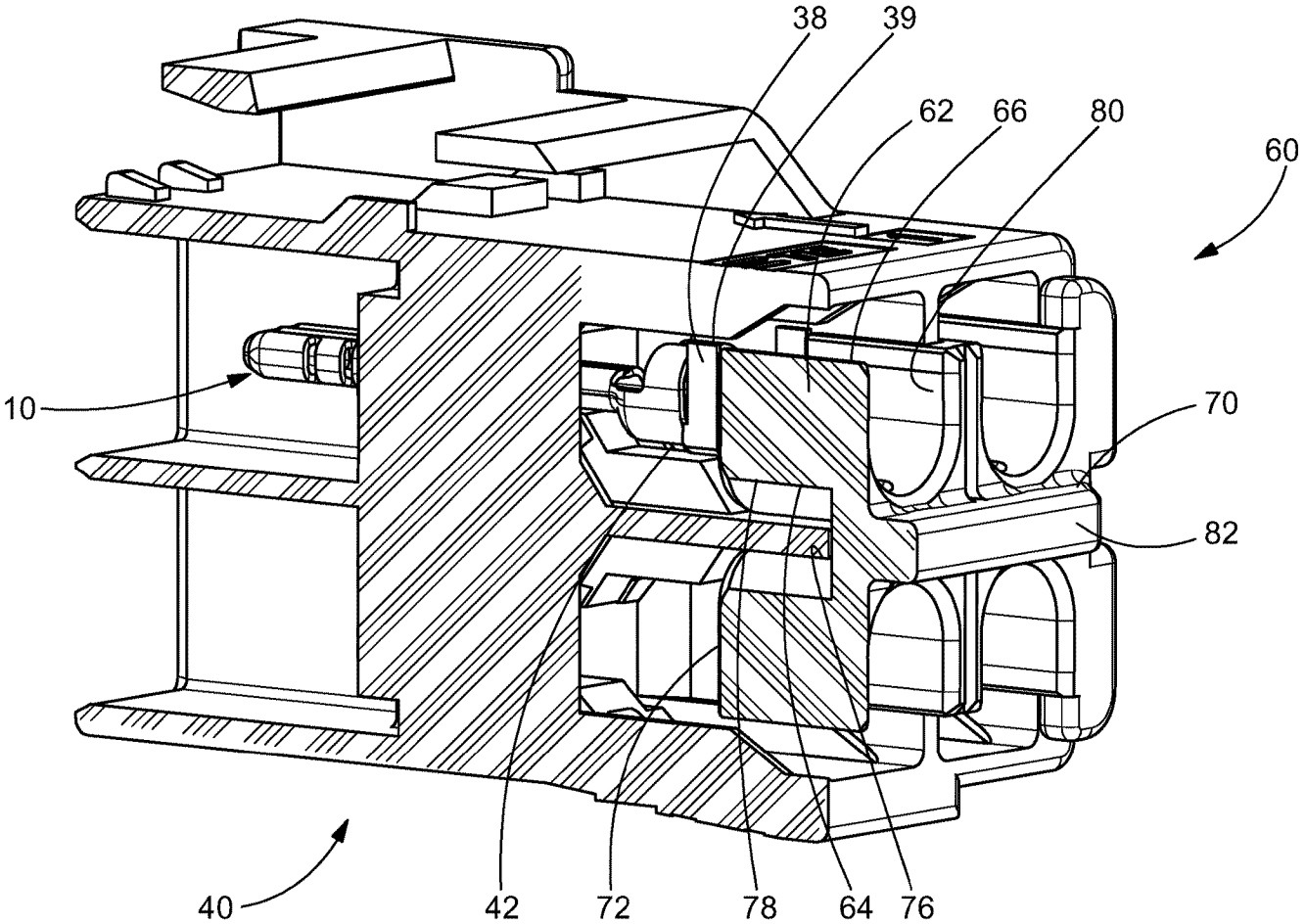
FIG. 6 is a perspective cross-sectional view taken along line 5-5 of FIG. 4.

As best shown in FIGS. 4 through 6, the terminal position assurance device 60 includes a first end 70 which extends across the length of the terminal position assurance device 60. A second end 72 is opposite the first end 70. The contact engagement sections 62 extend from the second end 72 toward the first end 70. The contact engagement sections 62 are separated by slots 76. In the illustrative embodiment, the contact engagement sections 62 are aligned in two rows which extend across the length of the terminal position assurance device 60. The contact engagement sections 62 have flat, planar surfaces 78 along the first sides 64 and curved surfaces 80 along the second sides 66. The curved surfaces are dimensioned to allow the wires or cables (not shown) to extend therethrough.

The first end 70 includes a raised section or rib 82 which extends from the first end 70 in a direction away from the second end 72. The raised section 82 extends at least part of the length of the terminal position assurance device 60 and is configured to provide a component that allows an assembler to push the terminal position assurance device 60 into position in the contact receiving cavities 42 of the housing 40. The raised section 82 also provides increase rigidity and strength to the terminal position assurance device 60.

The housing 40, contacts 10 and terminal position assurance device 60 form a connector assembly.

As shown in FIGS. 2 through 7, when the contacts 10 are loaded into the contact receiving cavities 42, the entire length of the contacts 10 are received into the contact receiving cavities 42. In this position, the side members 38 of the stabilizing portions 18 engage the sidewalls 50 of the contact receiving cavities. In addition, the end surfaces 39 of the side members 38 of the stabilizing portions 18 engage the surfaces 56. The cooperation of the side members 38 with the sidewalls 50 and/or the end surfaces 39 with the surfaces 56 ensure that the contacts 10 have minimal or no rotation relative to the housing 40. The engagement of the side members 38 of the stabilizing portions 18 with the sidewalls 50 limits the amount of horizontal movement of the ends of the contacts 10 relative to the housing 40. The engagement of the end surfaces 39 of the side members 38 of the stabilizing portions 18 with the surfaces 56 limits the amount of vertical movement of the ends of the contacts 10 relative to the housing 40.

Wires or cables (not shown) are terminated to the wire barrel 14 and the insulation barrel 16 of the contacts 10. The wires extend rearward from the interior of the contact receiving cavities 42 and out of the rear 20 of the housing 40.

The terminal position assurance device 60 is configured to be coupled to the rear of the housing 40. The contact engagement sections 62 of the terminal position assurance device 60 are received in corresponding contact receiving cavities 42. For example, when the terminal position assurance device 60 is coupled to the housing 40, the walls that define and separate the contact receiving cavities 42 are received in the slots 76 between the individual contact engagement sections 62, whereby each contact engagement section 62 enters a single contact receiving cavity 42.

The contact engagement sections 62 may be received in the corresponding contact receiving cavities 42 between the cable (not shown) extending from the contact 10 and an interior wall of the contact receiving cavity 42. The configuration of the contact engagement sections 62 allows the contact engagement sections 62 to be inserted into the cavities 42 and be positioned proximate respective walls 48, 50 of the cavities 42.

In an exemplary embodiment, the terminal position assurance device 60 couples to the housing 40 to restrict the contacts 10 from being forced, unintentionally, rearward out of the fully loaded position and/or out of the corresponding contact receiving cavities 42. In addition, when one of the contacts 10 is not fully loaded in the corresponding contact receiving cavity 42, the terminal position assurance device 60 may be configured to force the contact 10 further into the contact receiving cavity 42 towards and/or to the fully loaded position. For example, the second ends 72 of the contact engagement sections 62 may engage one or more of the stabilizing portions 18 of the contacts 10 that are not fully loaded when the terminal position assurance device 60 is being coupled to the housing 40, and as the contact engagement sections 62 advance into corresponding contact receiving cavities 42, the contact engagement sections 62 force the respective contacts 10 (e.g., via the stabilizing portions 18) further into the contact receiving cavities 42.

With the terminal position assurance device 60 fully inserted into the housing 40, the housing 40 can then be mated with a mating connector (not shown).

The contact engagement sections 62 of the terminal position assurance device 60 engage the stabilizing portions 18 along the side members 38, thereby providing additional stability to the contacts 10. In addition, portions of the bottom members 37 of the contacts 10 engage portions of the contact engagement sections 62 which are proximate the first sides 64. As the first sides 64 include the flat, planar surfaces 78 and are positioned proximate the raised sections or ribs 82, the first sides 64 are more stable and stronger than the second sides 66. Therefore, as the contact engagement sections 62 advance into corresponding contact receiving cavities 42, the bottom members 37 of the stabilizing portions 18 engage the strongest area of the terminal position assurance device 60 to increase the pull out force required to remove or displace the contact 10.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector assembly comprising:

a housing having stabilization members provided in contact receiving cavities;

contacts having contact portions for mating with mating contacts, stabilizing portions extending from ends of the contacts which are opposite the contact portions, the stabilizing portions have first members and second members, the second members cooperating with the stabilization members to minimize the rotation of the contacts relative to the housing, the second members extend essentially perpendicular to the first members;

a terminal position assurance device for engaging the stabilizing portions, the terminal position assurance device cooperating with the stabilizing portions to increase the pull out force required to displace the contacts.

2. The electrical connector assembly as recited in claim 1, wherein the terminal position assurance device has contact engagement sections which are received in the contact receiving cavities.

3. The electrical connector assembly as recited in claim 1, wherein the stabilization members are spaced from top walls and sidewalls of the contact receiving cavities.

4. The electrical connector assembly as recited in claim 1, wherein the first members engage the terminal position assurance device proximate first sides of the contact engagement sections.

5. The electrical connector assembly as recited in claim 4, wherein the second members have free end surfaces which cooperate with surfaces of the stabilization members to minimize the rotation of the contacts relative to the housing.

6. The electrical connector assembly as recited in claim 5, wherein transition portions are provided between the first members of the stabilizing portions and insulation barrels of the contacts.

7. The electrical connector assembly as recited in claim 2, wherein the contact engagement sections are separated by slots.

8. The electrical connector assembly as recited in claim 2, wherein the contact engagement sections are aligned in two rows which extend across the length of the terminal position assurance device.

9. An electrical connector assembly comprising:

a housing having contact receiving cavities, the contact receiving cavities have top walls, bottom walls and sidewalls, the contact receiving cavities have stabilizing members which are spaced from the top walls and the sidewall;

contacts positioned in the contact receiving cavities, the contacts having contact portions for mating with mating contacts, stabilizing portions have side members and bottom members, the side members of the stabilizing portions cooperate with the stabilization members of the contact receiving cavities to minimize the rotation of the contacts relative to the housing, the side members extend essentially perpendicular to the bottom members;

a terminal position assurance device having contact engagement sections received in the contact receiving cavities, the contact engagement sections configured to engage the side members and the bottom members of the stabilizing portions of the contacts when the terminal position assurance device is moved toward a fully inserted position.

10. The electrical connector assembly as recited in claim 9, wherein the contact engagement sections are separated by slots.

11. The electrical connector assembly as recited in claim 10, wherein the contact engagement sections are aligned in two rows which extend across the length of the terminal position assurance device.

12. The electrical connector assembly as recited in claim 11, wherein the contact engagement sections have flat, planar first surfaces along first sides and curved second surfaces along second sides, the curved second surfaces dimensioned to allow wires to extend therethrough.

13. The electrical connector assembly as recited in claim 12, wherein the terminal position assurance device includes a first end which extends across the length of the terminal position assurance device and a second end opposite the first end, the contact engagement sections extend from the second end toward the first end, the first end has a raised section which extends from the first end in a direction away from the second end.

14. The electrical connector assembly as recited in claim 13, wherein the raised section extends at least part of the length of the terminal position assurance device, the raised section configured to provide rigidity and strength to the terminal position assurance device.

15. The electrical connector assembly as recited in claim 13, wherein the terminal position assurance device has a coupling mechanism to allow the terminal position assurance device to be secured to the housing.

16. The electrical contact as recited in claim 9, wherein the stabilizing portions extend from insulation barrels of the contacts in a direction away from the contact portions.

* * * * *